US006505536B2

(12) United States Patent
Wilhelm

(10) Patent No.: US 6,505,536 B2
(45) Date of Patent: Jan. 14, 2003

(54) BUTTER CUTTER

(76) Inventor: Paul F. Wilhelm, 63 Hortontown Hill Rd., Hopewell Jct., NY (US) 12533

( * ) Notice: Subject to any disclaimer, the term of this patent is extended or adjusted under 35 U.S.C. 154(b) by 112 days.

(21) Appl. No.: 09/770,751

(22) Filed: Jan. 25, 2001

(65) Prior Publication Data

US 2001/0032535 A1 Oct. 25, 2001

Related U.S. Application Data

(60) Provisional application No. 60/198,132, filed on Apr. 17, 2000.

(51) Int. Cl.[7] ..... B26D 5/08

(52) U.S. Cl. ..... 83/409; 83/703; 83/437.5; 83/629; 83/432

(58) Field of Search ..... 83/703, 629, 409, 83/417, 437.5, 758, 932, 373, 717, 718, 719, 713, 734, 437.1, 437.2

(56) References Cited

U.S. PATENT DOCUMENTS

| | | | | | |
|---|---|---|---|---|---|
| 1,221,224 | A | | 4/1917 | Scanlan | 99/537 |
| 1,253,602 | A | | 1/1918 | Kavgag et al. | 99/537 |
| 1,334,304 | A | * | 3/1920 | Hodgdon et al. | 83/150 |
| 1,693,480 | A | * | 11/1928 | Gonyk | 131/233 |
| 2,111,035 | A | | 3/1938 | Winslow | 99/537 |
| 2,216,980 | A | | 10/1940 | Miller | 222/80 |
| 2,274,621 | A | * | 2/1942 | Wahlstrom et al. | 74/142 |
| 2,311,618 | A | * | 2/1943 | Coleman | 83/157 |
| 2,312,544 | A | * | 3/1943 | Gould et al. | 222/256 |
| 2,325,037 | A | | 7/1943 | Castro | 99/537 |
| 2,356,179 | A | * | 8/1944 | Proudman et al. | 83/229 |
| 2,471,100 | A | * | 5/1949 | Dodge | 221/93 |
| 2,471,399 | A | * | 5/1949 | Dodge | 221/267 |
| 2,506,919 | A | * | 5/1950 | Frank | 83/147 |
| 2,663,932 | A | | 12/1953 | Palazzolo | 222/80 |
| 2,692,429 | A | * | 10/1954 | Schweller et al. | 83/411.4 |
| 2,723,454 | A | * | 11/1955 | Janossy | 83/437.5 |
| 2,737,721 | A | * | 3/1956 | Hart | 222/80 |
| 2,809,428 | A | | 10/1957 | Puerner | 99/537 |
| 2,813,336 | A | | 11/1957 | Ackerman | 99/537 |
| 2,825,969 | A | * | 3/1958 | Honey | 53/519 |
| 3,920,156 | A | | 11/1975 | Hicks | 222/80 |
| 4,334,451 | A | * | 6/1982 | Bettcher | 83/703 |
| 4,436,012 | A | * | 3/1984 | Hochanadel | 83/703 |
| 4,513,501 | A | * | 4/1985 | Lee | 30/124 |
| 4,697,488 | A | * | 10/1987 | Cole | 83/417 |
| 5,621,972 | A | * | 4/1997 | Sala | 30/125 |
| 6,044,739 | A | * | 4/2000 | Abler et al. | 83/409.2 |

FOREIGN PATENT DOCUMENTS

| | | | |
|---|---|---|---|
| AU | B-67795/90 | 4/1991 | 222/80 |

* cited by examiner

*Primary Examiner*—Allan N. Shoap
*Assistant Examiner*—Stephen Choi
(74) *Attorney, Agent, or Firm*—N Paul Friederichs; Angenehm Law Firm

(57) ABSTRACT

A cutting device, including a receptacle for containing butter; a push mechanism for pushing the butter or margarine down into the receptacle, the push mechanism sitting atop a stick of butter and inside the receptacle, the push mechanism being in mechanical communication with the receptacle such that movement of the receptacle causes the push mechanism to move butter downward in relation to the receptacle, the push mechanism including a retrieval chain; a cutter, the cutter including a mechanism for knocking-off a piece of cut butter, the knocking off mechanism being a tapered piece; a gear mechanism in mechanical communication with the receptacle such that movement of the receptacle causes movement of the gear mechanism, the gear mechanism including at least one upper flat gear joined to the receptacle, a round gear joined to the frame and at least one lower flat gear joined to the cutter, wherein movement of the receptacle causes the upper flat gear to rotate the round gear, which in turn moves the lower flat gear and cutter; and a frame encapsulating the receptacle, gear mechanism, push mechanism and cutter.

20 Claims, 3 Drawing Sheets

BUTTER CUTTER

This application claims the benefit of Provisional Application No. 60/198,132, filed Apr. 17, 2000.

FIELD OF INVENTION

This invention relates to butter dishes and more particularly to butter dishes that cut slices of butter.

BACKGROUND

People have used butter dishes for storing butter for a very long time. Obtaining a portion of butter is not necessarily a neat task. Butter may be difficult to slice whether the butter is warm or cold. When the butter is warm, uniform slices cannot easily be produced, producing more of a glob than a slice. When the butter is cold, it is difficult to cut the butter and even more difficult to produce flat, uniform slices. Other problems also exist.

Typically, a person will use a knife to cut a slice of butter. The person will then spread the butter onto a slice of bread or toast. This person may then apply peanut butter or jelly to the slice of bread or toast. This person may then wish to cut another slice of butter for a second slice of bread or toast. The knife will likely contain breadcrumbs, peanut butter, jelly, or other particles. When the person cuts the second slice of butter, the breadcrumbs, peanut butter, jelly, or other particles are transferred to the butter. Many people find the transfer of these particles from one person's food to another's food distasteful.

Another problem with customary butter dishes is that these dishes do not protect the butter from contact with undesirable insects. For example, when the butter dish is left on the counter top or placed on the table for use, the butter is usually unprotected. Flies and insects easily come in contact with the butter. The butter dish will not likely have a barrier by which to prevent these insects from landing on the butter and leaving tracks.

Another problem with typical butter dishes is that they are difficult to wash. Many butter dishes may not be placed into dishwashers because of the material of which they are made. Washing butter dishes by hand may be an adventure. Butter is oil-based which creates the difficulty in washing butter dishes. One must use extremely hot water to clean butter dishes. Often water this hot is intolerable for the person washing butter dishes. Moreover, the person's hands become coated in the oil found in butter.

DRAWING FIGURES

FIG. 1 is a plan view of the present invention.

FIGS. 2 and 2*a* are plan views of the push mechanism.

SUMMARY

Figure 1:
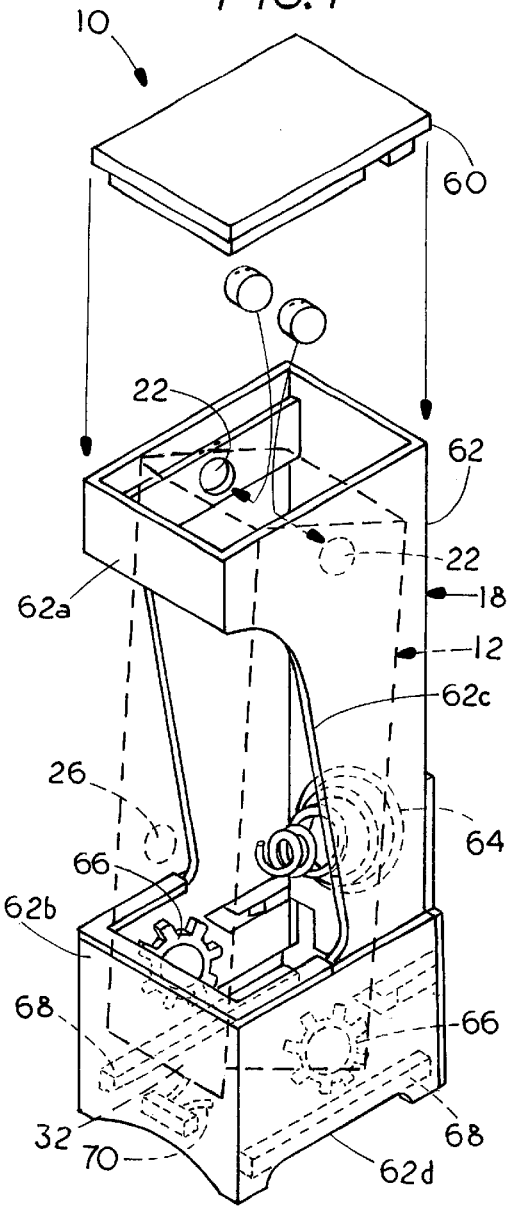

The present invention includes a receptacle mechanism for storage of a stick of butter or margarine (hereinafter butter). Inside the top portion of the receptacle mechanism is a push mechanism for pushing the butter down into the receptacle mechanism. A cutting mechanism for cutting slices of butter is attached to the lower portion of a frame mechanism. The frame mechanism also contains the receptacle mechanism.

The present invention prevents contamination of the butter within the receptacle mechanism. A person is able to obtain several slices of butter without using his/her knife. This prevents the person from needing to cut butter slices with his/her knife that he/she used with other food, which in turn prevents contamination of the butter with bread crumbs, peanut butter, jelly or other food particles and from allowing insects to attack the butter.

The present invention provides a method for easily obtaining a slice of butter with the use of only one hand. A person may grip the present invention with one hand by placing the frame adjacent to his/her palm and the receptacle mechanism adjacent to his/her fingers. The person then moves his/her fingers toward his/her palm, and thus, producing a slice of butter using only one hand.

In detailed operation, the person places a stick of butter into the receptacle mechanism. The push mechanism is next placed into the receptacle mechanism atop the butter. Pressured is applied to the receptacle mechanism by pulling the receptacle mechanism towards the back of the frame mechanism. This causes the push mechanism to move the butter into position for cutting. The pressure on the receptacle also causes a straight gear firmly secured to the receptacle to turn a round gear, which in turn moves a straight gear in a direction opposite the receptacle. The second straight gear is secured to a blade which slices through the butter extending below the receptacle. Release of the receptacle, allows the push mechanism to readjust relative to the receptacle; ready for the next slice.

DETAILED DESCRIPTION

The present inventive device 10, shown in FIGS. 1 through 7, includes a receptacle mechanism 12 for containing butter or margarine, a push mechanism 14 for pushing the butter or margarine down into the receptacle mechanism 12, a cutting mechanism 16 for cutting slices of the butter or margarine, and a frame mechanism 18 for encapsulating mechanisms 12, 14, and 16. These mechanisms 12, 14, 16, and 18 will be described in more detail below.

Figure 4:
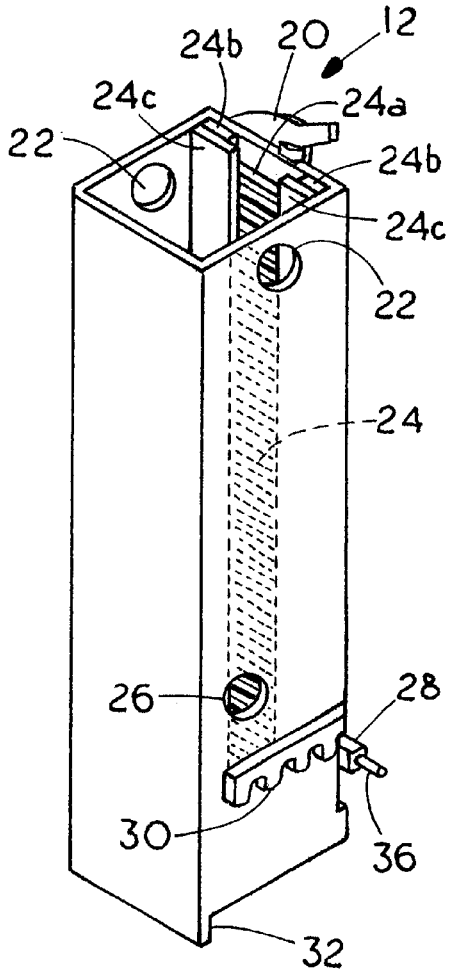
FIG. 4 is a plan view of the receptacle mechanism.
Figure 5:
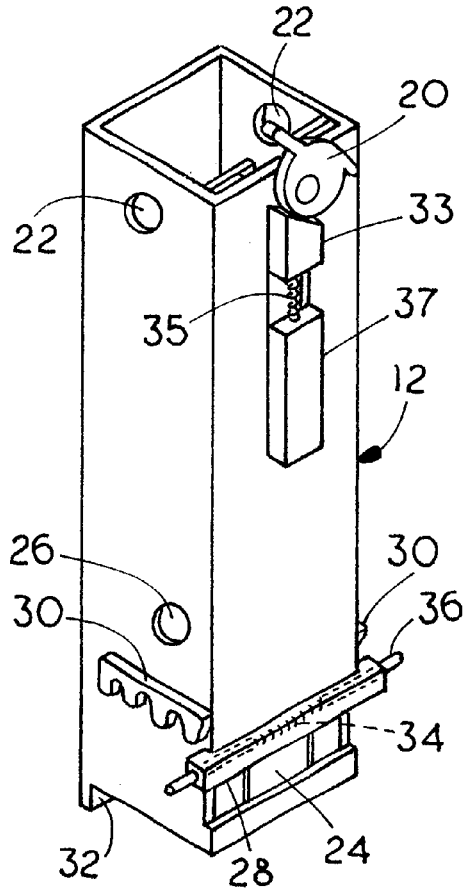
FIG. 5 is a back view of the receptacle mechanism.

As seen in FIG. 4, the receptacle mechanism 12 may include an adjustment mechanism 20, a pivot mechanism 22, a gear sheet 24, a view mechanism 26, a pin box 28, a plurality of strait gears 30, and a cutting surface 32. As seen in FIG. 5, the receptacle mechanism 12 also includes a gear sheet control mechanism 33, a gear sheet return spring 35, and an anchoring mechanism 37. These will be described in more detail below.

The receptacle mechanism 12 may be of a variety of sizes, shapes, and materials. The preferred size is large enough to contain an entire typical stick of butter or margarine (hereinafter butter) as well as the push mechanism 14. The receptacle mechanism 12 will preferably be a hollow rectangle. The receptacle mechanism 12 includes an upper rectangular opening (not shown) and a lower rectangular opening (not shown). The receptacle mechanism 12 preferably will be constructed of lightweight glass or plastic. Most preferably, the receptacle mechanism 12 will be non-breakable, clear plastic.

The adjustment mechanism 20 adjusts the thickness of the slice of butter. The adjustment mechanism 20 may be a rotatable oblong-shaped disc held with a screw or any other suitable mechanism for adjusting the thickness of the slice. The adjustment mechanism 20 works in conjunction with the gear sheet 24 and the gear sheet control mechanism 33.

The rotation of the adjustment mechanism 20 controls the distance the control mechanism 33 moves, e.g., the distance between the control mechanism 20 and the anchor mechanism 37, thereby controlling the distance traveled by the push block 14. The distance the push block 14 moves controls the thickness of the slice of butter.

The pivot mechanism 22 may be a plurality of pivot holes and pivot pins that enable the receptacle mechanism 12 to pivot within the frame 18 to an angle for improved cutting of a slice of butter or margarine. The pivot mechanism 22 works in conjunction with the frame mechanism 18. The plurality of pivot holes works in conjunction with the pivot pins and the frame mechanism 18 to allow the receptacle mechanism 12 to pivot within the frame mechanism 18.

The gear sheet 24 is located at the rearward wall within the receptacle mechanism 12. A gear sheet channel 24*a* is created prior to the gear sheet 24 being positioned within the receptacle mechanism 12. A pair of first blocks 24*b* is attached to the rearward inside corners of the receptacle mechanism 12. A pair of second blocks 24*c* is then attached, perhaps homogeneously, to the pair first blocks 24*b*. The pair of second blocks 24*c* are slightly wider than the pair of first blocks 24*b;* this creates a small channel beneath the second blocks 24*c* and above the back of the receptacle mechanism 12 through which the teeth of the gear sheet 24 are exposed to the push mechanism 14. The teeth of the gear sheet 24 are recessed beneath the second block 24*c,* which prevents the butter from coming into contact with the teeth of gear sheet 24.

As described below, the gear sheet 24, being drawn by the pin box 28, moves downward during the beginning of the cutting stroke. The gear sheet 24 returns to the up position during the cutting process. As stated above, the adjustment mechanism 20 may be set to limit the control mechanism 33 from returning to the top position and thereby reduce the amount of movement of the gear sheet 24 which, in the end, results in thinner slices.

The view mechanism 26 may be a plurality of openings defined within the receptacle mechanism 12. The view mechanism 26 allows the user of the present invention 10 to determine if the receptacle mechanism 12 needs to be refilled with butter or margarine. The present invention 10 may not include the view mechanism 26 particularly if the receptacle mechanism 12 is constructed of a transparent material.

The gear sheet control mechanism 33 may be any mechanism that will control the movement of the gear sheet 24. The gear sheet control mechanism 33 may be a control block. The control block 33 is attached to the backside of the gear sheet 24 through the upper rectangular opening on the receptacle mechanism 12. The control block 33 moves upward and downward with the gear sheet 24. The adjustment mechanism 20 controls how far the control block 33 will move upward and thus controls the thickness of the slices of butter.

The anchoring mechanism 37 may be any mechanism that provides the gear sheet spring 35 with an anchor. The anchoring mechanism 37 may be an anchor block. The anchor block 37 is attached to the outside of the receptacle mechanism 12 beneath the upper rectangular opening. The anchor block 37 does not move with the gear sheet 24. The anchor block 37 is stationary.

The gear sheet spring 35 is attached at one end to the control block 33 and attached to the anchor block 37 at the opposing end. The gear sheet spring 35 is forced down onto the anchor block 37 by the control block 33 as the gear sheet 24 moves downward. The gear sheet spring 35 re-extends at the end of the cutting stroke forcing the control block 33 to move upwards. The gear sheet 24 is forced upwards as the control block 33 moves upward, which causes the gear sheet 24 to return to its original starting position.

Figure 7:
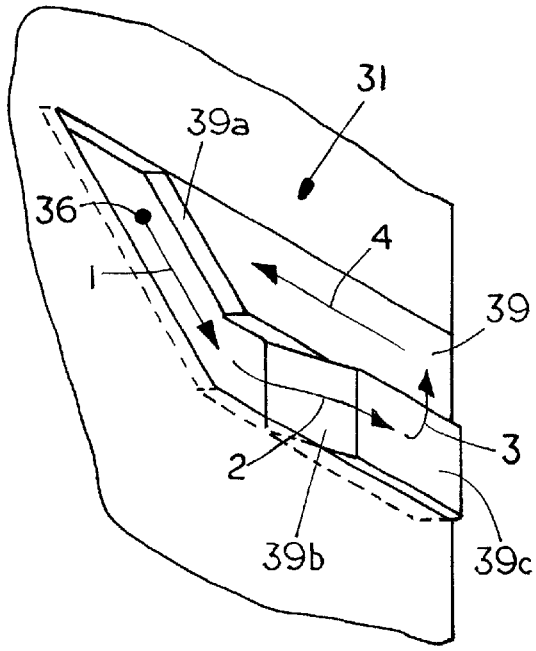
FIG. 7 is an expanded view of the push block advancing mechanism 31.

The pin box 28 may include a spring 34 and a plurality of control pins 36. The pin box 28 is attached through the lower rectangular opening of the receptacle mechanism 12 to the back of the gear sheet 24, forming the push block advancing mechanism 31. When the receptacle mechanism 12 is moved back toward the frame mechanism 18, the control pins 36 move downward (1) along the angled edge 39*a* of the pin box rotator 39 as shown in FIG. 7. This movement causes the gear sheet 24 to move downward. The control pins 36 then move up the ramp 39*b* of the pin box rotator 39 (2), pushing the pins 36 into the pin box 28. Once atop the ramp 39*b,* the gear sheet spring 35 forces the control block 33 to move upwards in the direction of the adjustment mechanism 20, drawing the gear sheet 24 and pin box 28 upward. The compressed control pins 36 slide along the major surface 39*c* of the pin box rotator 39 as indicated at (3). The return stroke (4), caused by a main spring 64 (discussed below), pushes the frame 18, secured to the pin box 28 back into their original positions, where the control pins 36 extend and are brought to rest against the angled edge 39*a*. The rotation of the pin box 28 completed, the device 10 is ready for the operation.

The plurality of strait gears 30, shown in FIGS. 4 and 5, may be any typical strait gears. The strait gears 30 may be permanently attached to or integral with outside surface of the sides of the receptacle mechanism 12. The strait gears 30 may be located near the lower portion of the receptacle mechanism 12. The strait gears 30 interact with a pair of round gears 66.

The receptacle mechanism 12 may have a cutting surface 32. The cutting surface 32 is shown in FIGS. 1, 4 and 5. The cutting surface 32 is the lower front edge of the receptacle mechanism 12. The cutting surface 32 may be slightly longer than the remaining three lower edges of the receptacle mechanism 12. The butter is cut against the cutting surface 32.

Figure 2:
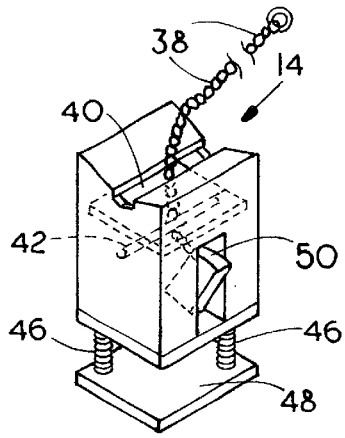
Figure 2A:
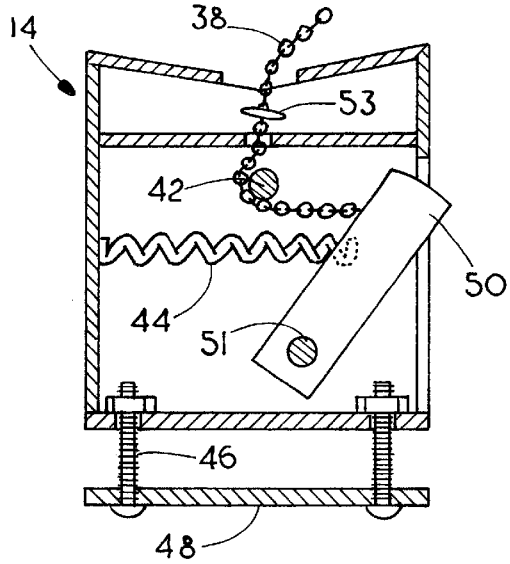

As shown in FIG. 2, the push mechanism 14 may include a retrieval chain 38, a storage area 40, a guide bar 42, a spring 44, a plurality of pins 46, a joggle plate 48, a latch 50 and a latch pivot rod 51. The retrieval chain 38, the storage area 40, the guide bar 42, the spring 44, the plurality of pins 46, the joggle plate 48, the latch 50 and the latch pivot rod 51 will be described in more detail below.

The push mechanism 14 is placed into the top of the receptacle mechanism 12 and then connected to the gear sheet 24 as explained below. The push mechanism 14 should be slightly smaller than the receptacle mechanism 12 so that the push mechanism 14 may be inserted into the receptacle mechanism 12. The push mechanism 14 may be approximately 1 ⅔ inches by 1 ¼ inch by 1 ¼ inch.

The retrieval chain 38 is stored inside of the storage area 40. The storage area 40 is located within the push mechanism 14. The retrieval chain 38 is a thin chain attached to the latch 50, which has a stop 53 disposed thereon to contain the chain within the areas as shown and described. When the butter needs to be refilled, a person tips the present invention 10 upside down and the retrieval chain 38 falls from the storage area 40. The person pulls the retrieval chain 38, which retracts the latch 50. The person is then able to remove the push mechanism 14 and refill the butter.

The guide bar 42 is inserted into and attached to the push mechanism 14. The retrieval chain 38 is placed beneath the guide bar 42 to change the angle/direction of pull to enable the retrieval chain 38 to pull back the latch 50.

The spring 44 is attached to the inside of the push mechanism 14. The spring 44 allows the latch 50 to generally remain in an extended position so that the latch 50 may lock into the teeth of the gear sheet 24, during the downward stroke. The spring 44 allows the latch 50 to retract when the gear sheet 24 is sliding upward into its starting position. This allows the push mechanism 14 to only move downward and not move upward during the cutting process.

One end of the plurality of pins 46 attaches to the lower portion of the push mechanism 14. The opposing end of plurality of pins 46 attaches to the joggle plate 48. Butter tends to be sticky and, therefore, may stick to the joggle plate 48. The plurality of pins 46 allows the joggle plate 48 to move downward, if attached to the butter, without moving the push mechanism 14 downward at the same time. This prevents extra thick slices of butter from being cut.

The latch 50 is attached to the latch pivot rod 51. The latch 50 is releasably locked into the teeth of the gear sheet 24. This causes the push mechanism 14 to move downward when the gear sheet 24 is moving downward. The latch pivot rod 51 allows the latch 50 to pivot during the movement of the gear sheet 24, which allows the push mechanism 14 to move downward with the gear sheet 24 and, yet, not upward with the gear sheet 24.

Figure 3:
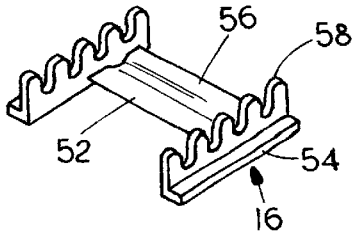
FIG. 3 is a plan view of the cutting mechanism.

The cutting mechanism 16, shown in FIG. 3, may include a blade 52, a pair of blade-guide mechanisms 54, a knock-off mechanism 56, and a pair of blade gears 58. The blade 52, the blade-guide mechanisms 54, the knock-off mechanism 56, and the blade gears 58 will be described in more detail below.

The blade 52 may be any typical blade such as a razor blade or other similar type of blade. The blade 52 should be approximately the same width, or slightly wider than, the width of a stick of butter to ensure a complete cut through the butter. The blade 52 may be approximately ½ inch in width and the length of the blade 52 is approximately 2 and ½ inches. The blade 52 is attached to the pair of blade-guide mechanisms at each end.

The pair of blade-guide mechanisms 54 may be any mechanism that will guide the blade 52 forward and backward during the cutting process. The blade-guide mechanisms 54 may be oval-shaped or rectangular-shaped rings or slats. The pair of blade-guide mechanisms 54 may be approximately one and ¾ inches in length. One blade-guide 54 may be inserted onto the blade 52 at each end adjacent to the cutting edge.

The knock-off mechanism 56 may be any mechanism that separates the butter from the blade 52. The knock-off mechanism 56 may be a long narrow strip that is attached at each end to the top of the pair of blade-guide mechanisms 54. The knock-off mechanism 56 may be wedge-shaped. As the blade 52 slides forward through the butter, the knock-off mechanism 56 slides between the butter and the blade 52.

The blade gears 58 may be any straight lined gear mechanism that meshes with the round gears 66. The blade gears 58 may be approximately 1 and ¾ inch in the length. The blade gears 58 may be attached to the pair of blade-guide mechanisms 54 along their lengths.

Figure 6:
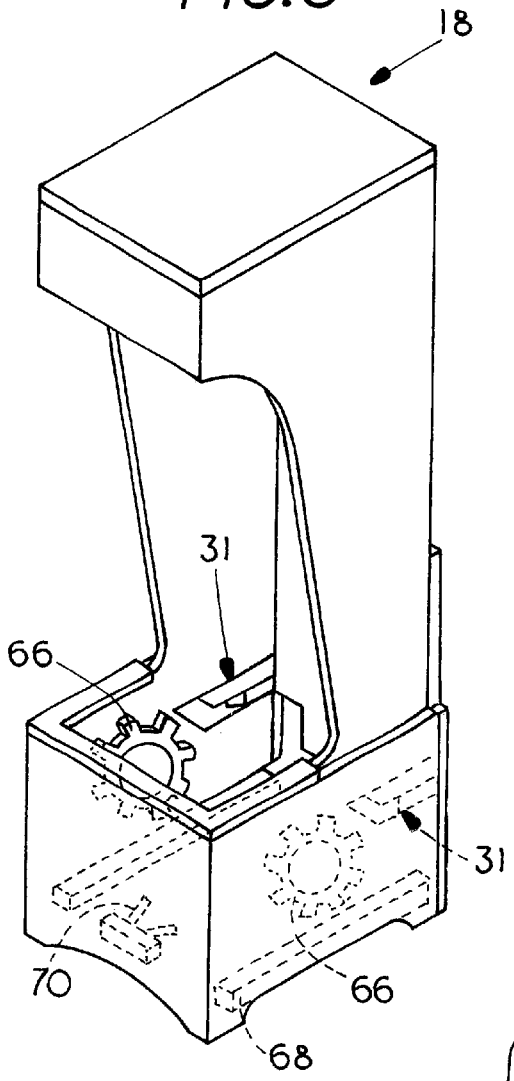
FIG. 6 is a plan view of the frame mechanism.

The frame mechanism 18 is shown in FIGS. 1 and 6. The frame mechanism 18 may include a cover 60, a frame 62, a main spring 64, a pair of round gears 66, a track 68, and a butter stop 70. The cover 60, the frame 62, the main spring 64, the pair of round gears 66, the track 68, and the butter stop 70 will be described in more detail below.

The cover 60 may be approximately three inches by approximately two inches by approximately ⅛ inch in dimension. The cover 60 may be placed over a top portion 62*a* of the frame mechanism 18. The cover 60 may be removed to insert or remove a stick of butter. The cover 60 may also be removed to insert or remove the receptacle mechanism 12 from the frame mechanism 18.

The frame 62 may be slightly taller than eight inches. The frame 62 may include the top portion 62*a,* a base portion 62*b,* and an opening 62*c*. The top portion 62*a* may be approximately one and ⅔ inch in height. The base portion 62*b* may be approximately two and ⅓ inch in height. The frame 62 is approximately three inches in depth and two inches in width.

The frame 62 may be enclosed at the top portion 62*a* using the cover 60. The base portion 62*b* may be separate from, though attached to, the frame 62. The base portion 62*b* may include a butter retrieval opening 62*d* so as to allow the user of the present invention 10 to obtain the recently cut slice of butter, which falls from the butter retrieval opening 62*d* by the force of gravity. The opening 62*c* is defined in between the top portion 62*a* and the base portion 62*b*. The opening 62*c* allows the user to squeeze the receptacle mechanism 12 into a vertical position for cutting a butter slice.

The main spring 64 returns the receptacle mechanism 12 to its original starting position after cutting a slice of butter as stated above. The main spring 64 is a conical spring. The main spring 64 is attached at one end to the outside of the receptacle mechanism 12 and to the inside of the frame mechanism 18 at the opposing end. When force is applied to the receptacle mechanism 12 to move it back towards the frame mechanism 18, the main spring 64 is forced against the frame mechanism 18. The main spring 64 becomes flattened by this action. When the force on the receptacle mechanism 12 is released, the main spring 64 expands to its original shape and thus partially rotates the receptacle mechanism 12 about the pivot mechanism 22 and back to its original position.

The round gears 66 may be attached to the opposing inside walls of the base portion 62*b* as shown in FIGS. 1 and 6. The round gears 66 should be attached to the base portion 62*b* in such a manner as to allow the round gears 66 to turn when activated by the strait gears 30. The round gears 66 are pinned to the inside of the base portion 62*b* of the frame 62. The round gears 66 have an opening defined in the center. A pin, with a cap, is inserted through the round gears 66. The pin is attached to an opening in the base portion 62*b*.

The track 68 is located in the base portion 62*b* beneath the round gears 66. The cutting mechanism 16 is inserted into the track 68. When the receptacle mechanism 12 is pulled towards the back of the frame 62, the cutting mechanism 16 will be moved forward to cut the butter.

The butter stop 70 prevents the butter from sliding out of the present invention 10. The butter stop 70 may be any mechanism that prevents the butter from sliding out of the present invention 10. The butter stop 70 is shown in FIGS. 1 and 6.

The present invention 10 is easy to use. The cutting mechanism 16 is inserted into the track 68 of the frame mechanism 18. The receptacle mechanism 12 is inserted into the frame mechanism 18 if it is not currently within the frame mechanism 18. Typically, the receptacle mechanism 12 will stay within the frame mechanism 18. A stick of butter or margarine is inserted into the receptacle mechanism 12. The push mechanism 14 is inserted into the top of the receptacle mechanism 12 lining up the teeth of the gear sheet 24 with latch 50. The cover 60 is placed onto the top portion 62*a*.

The user holds the present invention 10 with the opening 62*c* adjacent to the user's fingers and the back of the frame 62 adjacent to the user's palm. The user then pulls the receptacle mechanism 12 towards the back of the frame 62. A slice of butter will be cut by the cutting mechanism 16 and released at the bottom of the base portion 62*b*.

The strait gears 30 mesh with the top of the round gears 66. The blade gears 58 mesh with the bottom of the round gears 66. When the receptacle mechanism 12 is pulled towards the back of the frame 62, the round gears 66 turn. The turning of the round gears 66 pushes the blade gears 58 forward. Because the blade gears 58 are attached to the cutting mechanism 16, the blade 52 moves forward with the blade gears 58. As the blade 52 is moving forward, the receptacle mechanism 12 moves the butter backward. This reduces the stroke length in half.

In an alternative embodiment, the blade 52 is formed such that the knock-off mechanism 56 is integral with the blade 52. The blade 52 may be wedge-shaped. The wedge-shaped blade 52 is thicker which prevents bending of the blade 52. The wedge-shaped blade 52 also provides the knock-off mechanism 56 to cause the butter to be knocked off the blade 52.

Although the present invention has been described with reference to preferred embodiments, workers skilled in the art will recognize changes may be made in form and detail without departing from the spirit and scope of the invention.

I claim:

1. A cutting device, comprising:

a receptacle for containing butter;

push means for pushing the butter or margarine down into the receptacle, the push means sitting atop a stick of butter and inside the receptacle, the push means being in mechanical engagement with the receptacle such that movement of the receptacle causes the push means to move butter downward in relation to the receptacle;

gear means in mechanical engagement with the receptacle such that movement of the receptacle causes movement of the gear means;

a cutter in mechanical engagement with the gear means such that movement of the gears causes movement of the cutter; and a frame encapsulating the receptacle, push means, gear means and cutter.

2. The device of claim 1 wherein the receptacle comprises a cutting surface.

3. The device of claim 1 wherein the receptacle is see through.

4. The device of claim 1 wherein the receptacle moves from a near vertical to a vertical position when cutting a slice of butter.

5. The device of claim 1 wherein the gear means comprises flat gears and round gears.

6. The device of claim 5 wherein flat gears are secured to the receptacle.

7. The device of claim 5 wherein two flat gears oppose each other with a round gear disposed therebetween.

8. The device of claim 1 further comprising means for determining the thickness of a slice of butter.

9. The device of claim 8 wherein the determining means is adjustable.

10. The device of claim 1 further comprising a main spring operable between the frame and the receptacle.

11. A cutting device, comprising:

a receptacle for containing butter;

push means for pushing the butter or margarine down into the receptacle, the push means sitting atop a stick of butter and inside the receptacle, the push means being in mechanical engagement with the receptacle such that movement of the receptacle causes the push means to move butter downward in relation to the receptacle;

a cutter;

gear means in mechanical engagement with the receptacle such that movement of the receptacle causes movement of the gear means, the gear means comprising at least one upper flat gear joined to the receptacle, a round gear joined to the frame and at least one lower flat gear joined to the cutter, wherein movement of the receptacle causes the upper flat gear to rotate the round gear, which in turn moves the lower flat gear and cutter; and a frame encapsulating the receptacle, gear means, push means and cutter.

12. The device of claim 11 wherein the push means further comprises a latch.

13. The device of claim 12 wherein the latch pivots.

14. The device of claim 11 wherein the push means further comprises a retrieval chain.

15. The device of claim 11 further comprising means for knocking-off a piece of cut butter.

16. The device of claim 15 wherein the knock-off means is integral with the cutter.

17. The device of claim 11 wherein the butter is synthetic butter.

18. The device of claim 11 wherein the receptacle further comprises means for viewing the butter.

19. The device of claim 18 wherein the viewing means comprises openings in the receptacle.

20. A cutting device, comprising:

a receptacle for containing butter;

push means for pushing the butter or margarine down into the receptacle, the push means sitting atop a stick of butter and inside the receptacle, the push means being in mechanical engagement with the receptacle such that movement of the receptacle causes the push means to move butter downward in relation to the receptacle, the push means including a retrieval chain;

a cutter, the cutter comprising means for knocking-off a piece of cut butter, the knocking off means being a tapered piece;

gear means in mechanical engagement with the receptacle such that movement of the receptacle causes movement of the gear means, the gear means comprising at least one upper flat gear joined to the receptacle, a round gear joined to the frame and at least one lower flat gear joined to the cutter, wherein movement of the receptacle causes the upper flat gear to rotate the round gear, which in turn moves the lower flat gear and cutter; and a frame encapsulating the receptacle, gear means, push means and cutter.

* * * * *